US007333757B2

(12) United States Patent
Oshika

(10) Patent No.: US 7,333,757 B2
(45) Date of Patent: Feb. 19, 2008

(54) DEVELOPING DEVICE WITH DEVELOPING BLADE HAVING CURVED PORTION AND IMAGE FORMING DEVICE

(75) Inventor: Hirotaka Oshika, Tokyo (JP)

(73) Assignee: Oki Data Corporation, Tokyo (JP)

( * ) Notice: Subject to any disclaimer, the term of this patent is extended or adjusted under 35 U.S.C. 154(b) by 26 days.

(21) Appl. No.: 11/196,272

(22) Filed: Aug. 4, 2005

(65) Prior Publication Data

US 2006/0045576 A1 Mar. 2, 2006

(30) Foreign Application Priority Data

Aug. 26, 2004 (JP) ..... 2004-246454

(51) Int. Cl.
*G03G 15/08* (2006.01)

(52) U.S. Cl. ..... 399/284

(58) Field of Classification Search ..... 399/273, 399/274, 283, 284; 118/261
See application file for complete search history.

(56) References Cited

U.S. PATENT DOCUMENTS 5,587,551 A * 12/1996 Ikegawa et al. ..... 399/284

FOREIGN PATENT DOCUMENTS

JP 2001-305856 11/2001
JP 2004004751 A * 1/2004

* cited by examiner

*Primary Examiner*—David M. Gray
*Assistant Examiner*—Laura K Roth
(74) *Attorney, Agent, or Firm*—Takeuchi & Kubotera, LLP

(57) ABSTRACT

A developing device includes a developer support member and a developing blade having a curved portion abutting against the developer support member. When Rc represents a minimum curvature radius of the curved portion of the developing blade and R represents a curvature radius at an abutting point where the curved portion abuts against the developer support member, a ratio of R to Rc (R/Rc) meets the following relation.

$1.0 \leqq R/Rc \leqq 1.2$

9 Claims, 8 Drawing Sheets

DEVELOPING DEVICE WITH DEVELOPING BLADE HAVING CURVED PORTION AND IMAGE FORMING DEVICE

BACKGROUND OF THE INVENTION

The present invention relates to a developing device and an image forming device having the developing device.

A conventional image forming device of an electric photography type such as a printer, a copier, and a facsimile forms an image through an electric photography process. Such an image forming device includes a charging roller for uniformly charging a surface of a photosensitive drum; an exposure unit for exposing the surface of the photosensitive drum to form a static latent image thereon; a developing roller for attaching toner to the static latent image to form a toner image; a toner supply roller for charging and supplying toner to the developing roller; a developing blade for forming a toner layer with a uniform thickness on a surface of the developing roller; a transfer roller for transferring the toner image on the surface of the photosensitive drum to a sheet; and a cleaning device for collecting toner not transferred and remaining on the surface of the photosensitive drum.

Japanese Patent Publication No. 2001-305856 has disclosed a developing blade. When a toner layer is formed on a surface of a developing roller, the developing blade scrapes excess toner on the surface of the developing roller, thereby making a thickness of the toner layer uniform. In Japanese Patent Publication No. 2001-305856, the developing blade is formed of an elastic plate member for easily scraping toner, and a curved portion of the developing blade is pressed against the developing roller.

The curved portion of the developing blade is pressed against the developing roller at a downstream side in a direction that the developing roller rotates relative to a top of the curved portion of the developing blade. The top of the curved portion of the developing blade has a minimum curvature radius, and the curvature radius increases toward a downstream side in a direction that the developing roller rotates. That is, when Rc represents the curvature radius at the top of the curved portion of the developing blade and R represents the curvature radius at the abutting point where the developing blade abuts against the developing roller, the following relation is established.

$$Rc \leqq R$$

It is possible to adjust a thickness of the toner layer on the surface of the developing roller through the curvature radius of the abutting point. In the image forming device disclosed in Japanese Patent Publication No. 2001-305856, the toner tends to expel each other due to a charged state of the toner. Accordingly, the developing blade is lifted through an expel force, thereby shifting the abutting point between the developing blade and the developing roller. As described above, the top of the curved portion of the developing blade has a minimum curvature radius, and the curvature radius increases toward the downstream side in a direction that the developing roller rotates. Therefore, when the abutting point is shifted, the curvature radius R at the abutting point is also changed. As a result, the thickness of the toner on the surface of the developing roller changes, thereby making it difficult to stably form an image.

In view of the problems described above, an object of the present invention is to provide a developing device and an image forming device for forming a toner layer with a uniform thickness on a surface of a developing roller, so that an image is stably formed even when an abutting point between a developing blade and the developing roller is shifted.

Further objects and advantages of the invention will be apparent from the following description of the invention.

SUMMARY OF THE INVENTION

In order to attain the objects described above, according to the present invention, a developing device comprises a developer support member and a developing blade having a curved portion abutting against the developer support member. When Rc represents a minimum curvature radius of the curved portion of the developing blade and R represents a curvature radius at an abutting point where the curved portion abuts against the developer support member, a ratio of R to Rc (R/Rc) meets the following relation.

$$1.0 \leqq R/Rc \leqq 1.2$$

DETAILED DESCRIPTION OF THE PREFERRED EMBODIMENTS

Hereunder, embodiments of the present invention will be explained with reference to the accompanying drawings. In the embodiments, an image forming device of an electric photography type is applied to a printer.

First Embodiment

Figure 1:
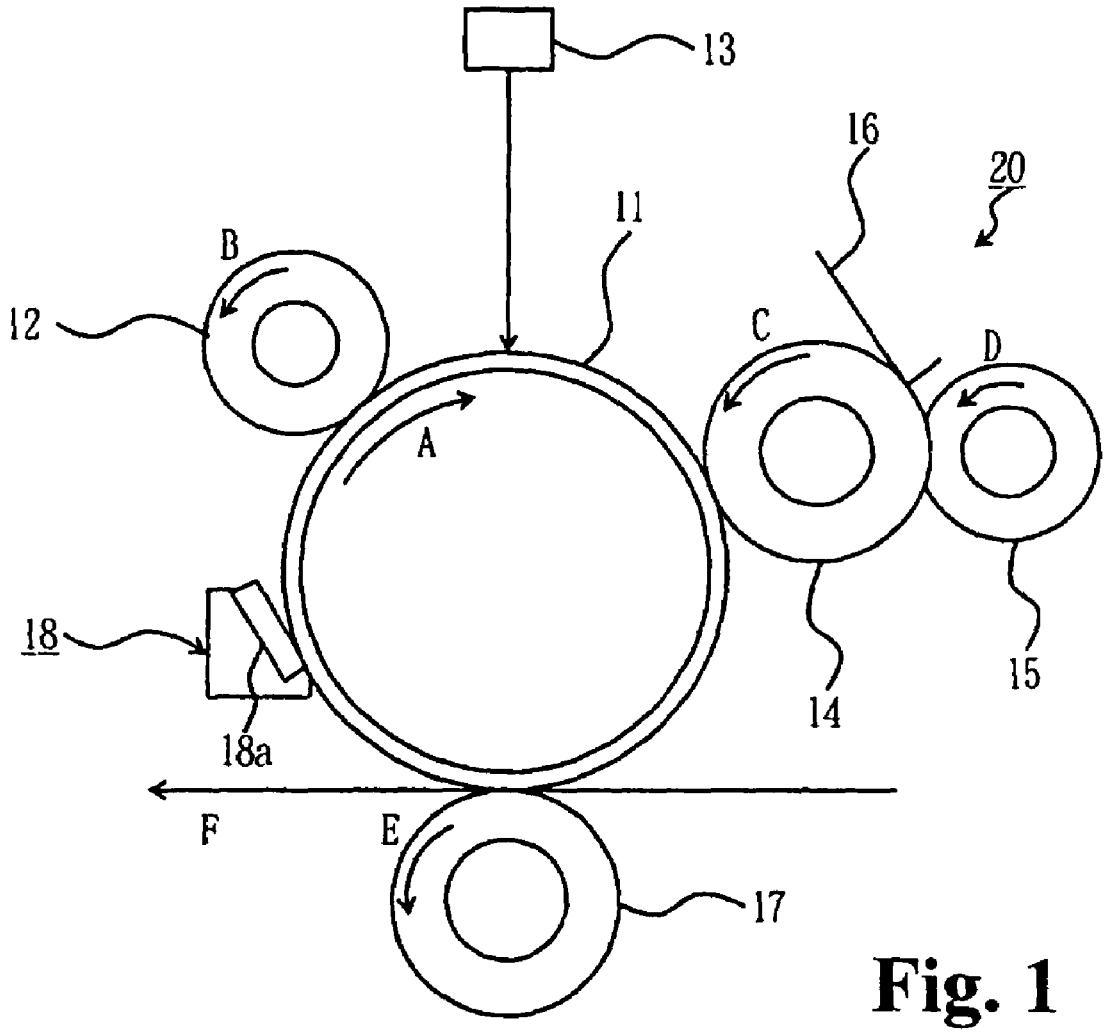
FIG. 1 is a schematic view showing an image forming device according to a first embodiment of the present invention.

FIG. 1 is a schematic view showing an image forming device according to a first embodiment of the present invention. As shown in FIG. 1, the image forming device includes a photosensitive drum 11 as an image supporting member to freely rotate in an arrow direction A. A charging roller 12 is arranged as a charging device to face and contact with the photosensitive drum 11, and freely rotates in an arrow direction B. The charging roller 12 uniformly charges a surface of the photosensitive drum 11 with negative polarity. An exposure device 13 irradiates light corresponding to a printing pattern on the surface of the photosensitive drum 11, so that a static latent image corresponding to the printing pattern is formed on the surface of the photosensitive drum 11.

As shown in FIG. 1, a developing unit 20 includes a developing roller 14 as a developer supporting member; a toner supply roller 15 as a developer supply member; and a developing blade 16. The developing roller 14 is arranged to face and contact with the photosensitive drum 11, and freely rotates in an arrow direction C. The toner supply roller 15 is arranged to face and contact with the developing roller 14, and freely rotates in an arrow direction D. The developing blade 16 is arranged to abut against the developing roller 14.

The developing blade 16 contacts with the developing roller 14 to charge toner with negative polarity through friction, so that a thin toner layer is formed on a surface of the developing roller 14. The developing roller 14 supplies toner to the photosensitive drum 11 for developing, so that a toner image is formed on the surface of the photosensitive drum 11 as a developer image or a visible image. In the embodiment, the toner supply roller 15 contacts with the developing roller 14, and may be arranged not to contact with the developing roller 14.

A transfer roller 17 is disposed below the photosensitive drum 11 as a transfer device to face and contact with the photosensitive drum 11, and freely rotates in an arrow direction E. The transfer roller 17 transfers the toner image on the surface of the photosensitive drum 11 to a sheet supplied from a sheet supply device (not shown) and moving in an arrow direction F as a printing medium. A cleaning device 18 is provided for collecting toner remaining on the surface of the photosensitive drum 11 after the transfer roller 17 transfers the toner image to the sheet. The cleaning device 18 is provided with a cleaning blade 18*a* facing and contacting with the photosensitive drum 11. The cleaning blade 18*a* scrapes toner, and the cleaning device 18 collect toner for recycling or discarding.

After transferring the toner image, the sheet is transported to a fixing device (not shown), so that the toner is melted and attached to the sheet, thereby fixing the toner image to the sheet. After printing the sheet, the sheet is discharged outside the printer with a discharge device (not shown). In the embodiment, the photosensitive drum 11, the charging roller 12, the developing unit 20, and the cleaning device 18 are assembled in a unit as a process cartridge of a developing device. A toner cartridge is detachably attached to the process cartridge.

When the toner layer is formed on the surface of the developing roller 14, the developing blade 16 scrapes excess toner on the surface of the developing roller 14 to make a thickness of the toner layer uniform. Accordingly, the developing blade 16 is formed of an elastic plate member bent in an L shape to make it easy to scrape excess toner on the surface of the developing roller 14. A bent portion or a curved portion of the developing blade 16 is pressed against the developing roller 14. A material of the developing blade 16 includes SUS (stainless steel) and phosphor bronze.

It is preferred that the developing blade 16 has a thickness of 0.05 to 0.5 mm. When the developing blade 16 has a too small thickness, i.e., less than 0.05 mm, in addition to deteriorating durability, it is difficult to press the developing blade 16 against the developing roller 14 with a sufficient force and adjust an amount of toner attached to the surface of the developing roller 14. When the developing blade 16 has a too large thickness, i.e., larger than 0.5 mm, it is difficult to accurately bend the developing blade 16 such that a curvature radius continuously increases from a top of the curved portion of the developing blade 16 toward a downstream side in a direction that the developing roller 14 rotates. Further, when the developing blade 16 has a too large thickness, the plate member may generate a crack at the curved portion of the developing blade 16 due to difference in bending characteristics at an upstream side and a downstream side in a direction that the developing roller 14 rotates.

It is preferred to set a curvature radius of a curved portion from the top of the curved portion of the developing blade 16 to a downstream side in a direction that the developing roller 14 rotates between 0.1 and 1.0 mm in view of strength and long term durability. The curve portion of the developing blade 16 at a downstream side in a direction that the developing roller 14 rotates from the top of the curved portion is pressed against the developing roller 14.

Figure 2:
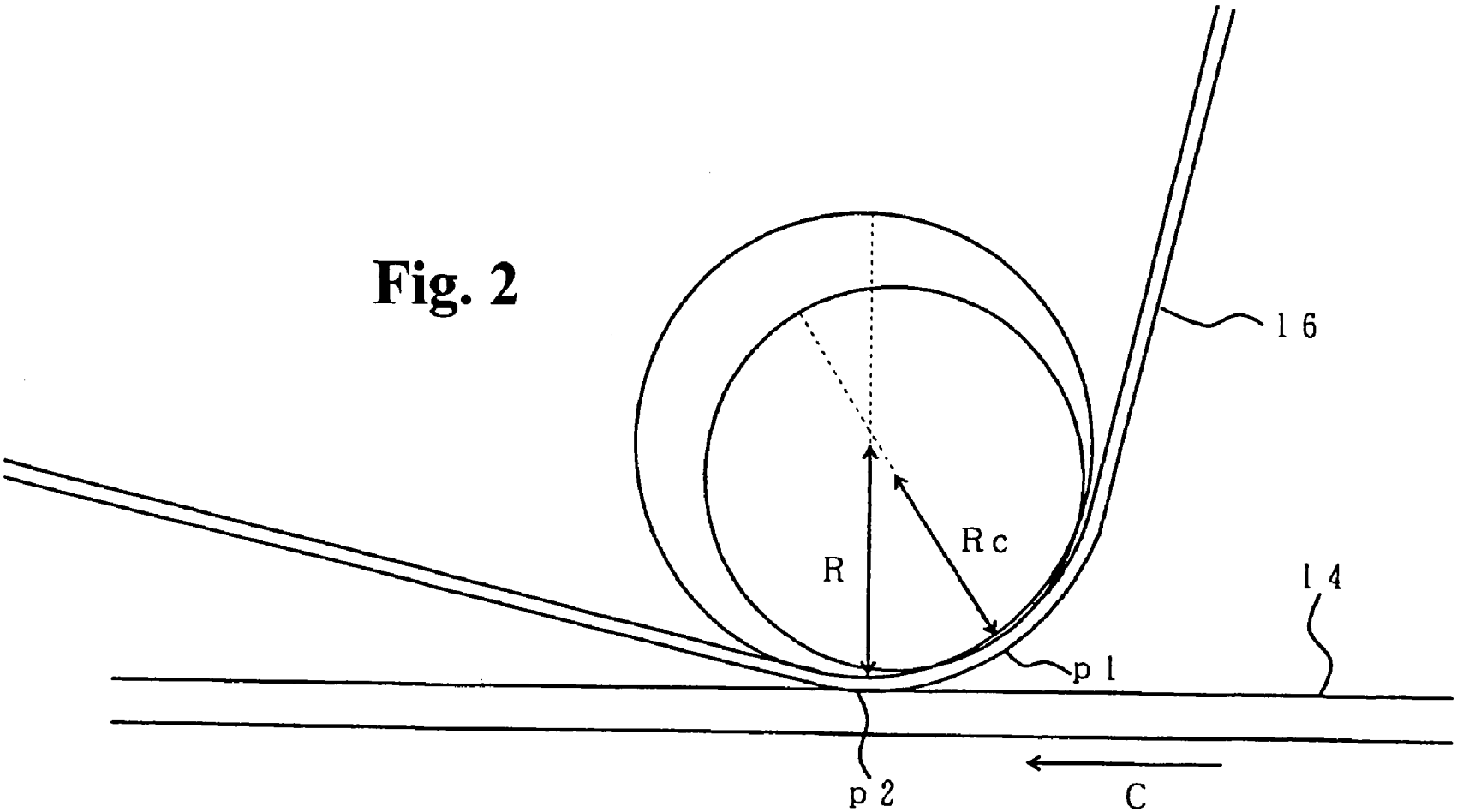
FIG. 2 is a schematic view showing a curved portion of a developing blade formed with a bending process according to the first embodiment of the present invention.

A process of forming the developing blade 16 according to the first embodiment of the present invention will be explained next. FIG. 2 is a schematic view showing the curved portion of the developing blade 16 formed with a bending process according to the first embodiment of the present invention. When Rc represents a minimum curvature radius of the curved portion of the developing blade 16, or a top p1, and R represents a curvature radius at an abutting point p2 between the developing blade 16 and the developing roller 14, a ratio of R to Rc (R/Rc) meets the following relation.

$$1.0 \leqq R/Rc \leqq 1.2$$

As described above, the curvature radius Rc and the curvature radius R are within 0.1 to 1.0 mm. In a process of manufacturing the developing blade 16, a metal mold is used for bending the plate member to have the curvature radius Rc. When the plate member is bent with the metal mold, a winkle is generated on a surface of the plate member. Accordingly, after bending the plate member, the surface of the plate member is polished to have a surface roughness less than 1 μm. With the polishing process, it is possible to adjust the curvature radius R of the abutting portion p2. A method of polishing includes a buffing method and a sandblast method. The sandblast method provides accurate polishing, so that the curvature radius R of the abutting portion p2 is accurately adjusted.

In the embodiment, the surface roughness represents a surface roughness along a direction that the developing roller 14 rotates. The surface roughness adopts a ten-point average roughness. To obtain the ten-point average roughness, first, a standard length is obtained from a roughness profile of the plate member along an average line. Then, a first average of absolute heights of highest to fifth highest portions from the average line in the standard length is obtained. Similarly, a second average of absolute heights of deepest to fifth deepest portions from the average line in the standard length is obtained. The ten-point average roughness is obtained from a sum of the first average and the second average.

Figure 3:
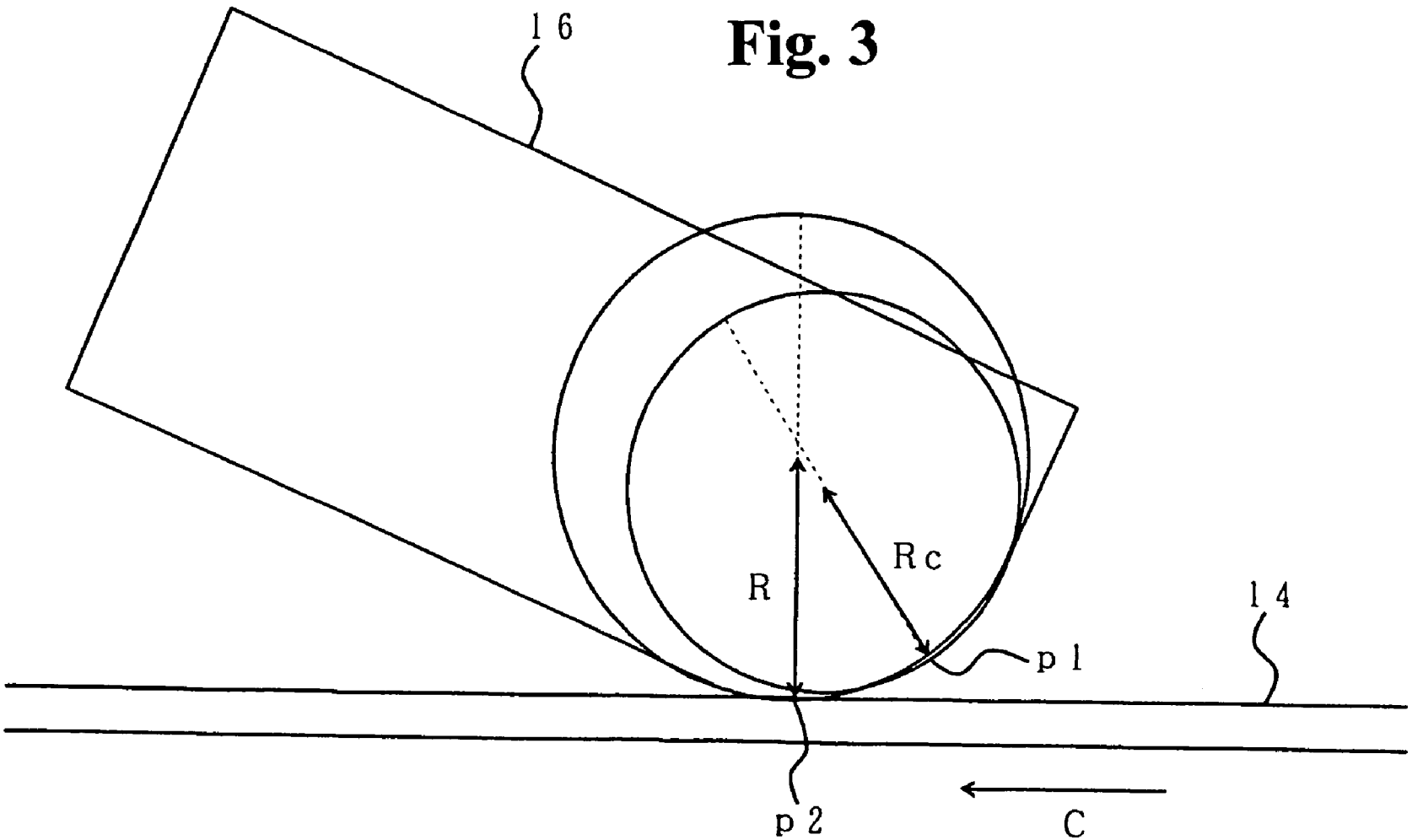
FIG. 3 is a schematic view showing a curved portion of a developing blade formed with a grinding process according to the first embodiment of the present invention.

FIG. 3 is a schematic view showing the curved portion of the developing blade 16 formed with a grinding process according to the first embodiment of the present invention. In the process of grinding the developing blade 16, the plate member is formed of an elastic member with a thickness greater than 1.0 mm, so that the curvature radius R of the abutting portion p2 increases as compared with the bending process. When the curvature radius R of the abutting portion p2 increases, a contact area between the developing roller 14 and the developing blade 16 increases, thereby making it easy to charge toner through friction.

A material of the plate member constituting the developing blade 16 includes SUS (stainless steel) and phosphor bronze. Instead of metal, the plate member may be formed of a resin material such as silicone rubber and urethane rubber. When the developing blade 16 is formed of a resin material, it is preferred to add carbon black or an ion conductive material to the resin material. When the curved portion of the developing blade 16 is formed with a grinding process, it is possible to improve dimensional accuracy of the curvature radius R of the abutting portion p2 as compared with the bending process.

An operation of the developing blade 16 according to the first embodiment will be explained next. After toner is supplied to the developing unit 20 from a toner storage unit (not shown), the toner supply roller 15 supplies toner to the developing roller 14. At this time, toner is attached to the surface of the developing roller 14 to form a toner layer with a random thickness, not a uniform thickness. When the developing roller 14 rotates to pass the toner layer with a random thickness through the abutting portion between the developing roller 14 and the developing blade 16, the developing blade 16 scrapes excess toner to make the thickness of the toner layer uniform. At this time, the thickness of the toner layer is determined by the curvature radius R of the abutting portion p2 at the curved portion of the developing blade 16. After toner is uniformly attached to the surface of the developing roller 14, toner is attached to a latent static image on the surface of the photosensitive drum 11, thereby forming a toner image on the surface of the photosensitive drum 11.

It is designed that the abutting portion p2 at the curved portion of the developing blade 16 is stationary. However, when the toner supply roller 15 supplies toner to the developing roller 14, toner is charged on the surface of the developing roller 14 and repels with each other. In this case, a repel force increases as a charge amount of toner increases. When toner repels with each other, the developing blade 16 is lifted from the surface of the developing roller 14, thereby shifting a position of the abutting portion p2. An amount of a change in the curvature radius relative to an amount of the shift of the abutting portion p2 is proportional to the ratio R/Rc of the curvature radius R of the abutting point p2 to the curvature radius Rc of the curved portion of the top p1.

Table 1 shows a relationship between the ratio R/Rc of the curvature radius R to the curvature radius Rc and amounts of fresh toner and aged toner attached to the surface of the developing roller 14. An additive such as a toner surface modifier contained in the fresh toner functions effectively, so that the fresh toner has a small variance in a particle diameter. On the other hand, the additive is lost or embedded in a toner particle to lose function with time, so that the aged toner has a large variance in a particle diameter. The fresh toner and the aged toner are charged differently, thereby changing the repel force of toner. Accordingly, when the fresh toner is used, an amount of lifting the developing blade 16 is different from a case that the aged toner is used, thereby changing an amount of toner attached to the developing roller 14.

In Table 1, an attached toner amount represents an amount of toner (mg) per one square centimeter ($cm^2$) of the surface of the developing roller 14. The measurement of the attached toner amount was performed as follows. First, a double-side adhesive tape was attached to a metal tool having a shape corresponding to an outer circumferential surface of the developing roller 14. The metal tool was charged with positive polarity, and was approached toward the developing roller 14, so that toner on the surface of the developing roller 14 was attached to the metal tool. Then, a weight of toner attached to the metal tool was measured. A series of steps described above was repeated until toner on the surface of the developing roller 14 was all consumed. A sum of toner attached to the metal tool represents the attached toner amount.

TABLE 1

| Curvature Radius of Developing Blade | | | Attached Toner Amount (mg) | | |
|---|---|---|---|---|---|
| | | | Fresh | Aged | |
| Rc (mm) | R (mm) | R/Rc | Toner | Toner | Difference |
| 0.23 | 0.25 | 1.09 | 0.62 | 0.64 | 0.02 |
| 0.23 | 0.27 | 1.17 | 0.65 | 0.68 | 0.03 |
| 0.23 | 0.28 | 1.20 | 0.66 | 0.74 | 0.08 |
| 0.23 | 0.29 | 1.26 | 0.67 | 0.79 | 0.12 |
| 0.30 | 0.33 | 1.10 | 0.75 | 0.78 | 0.03 |
| 0.30 | 0.35 | 1.17 | 0.78 | 0.83 | 0.05 |
| 0.30 | 0.36 | 1.20 | 0.79 | 0.87 | 0.08 |
| 0.30 | 0.40 | 1.33 | 0.82 | 0.96 | 0.14 |

In Table 1, there is a difference in the attached toner amount between the fresh toner and the aged toner. This is because, as described above, the fresh toner and the aged toner are charged differently, thereby changing an amount of lifting the developing blade 16.

One of parameters indicating printing performance includes OD (Optical Density). The OD represents reflectivity at a most black portion of a printed sheet. When a variance of the OD is within ±0.1, it is possible to maintain good printing quality. From a previous experiment, it is found that when a variance in the attached toner amount is less than 0.1 mg, it is possible to maintain the OD within ±0.1. Accordingly, in the embodiment, when the ratio of R to Rc (R/Rc) meets the following relation, $$1.0 \leqq R/Rc \leqq 1.2$$

it is possible to maintain the variance in the attached toner amount less than 0.1 even though the charged state of toner is changed. Accordingly, regardless of the charged state of toner changing with time, it is possible to form the toner layer with a uniform thickness, thereby stably forming an image.

Second Embodiment

Figure 4:
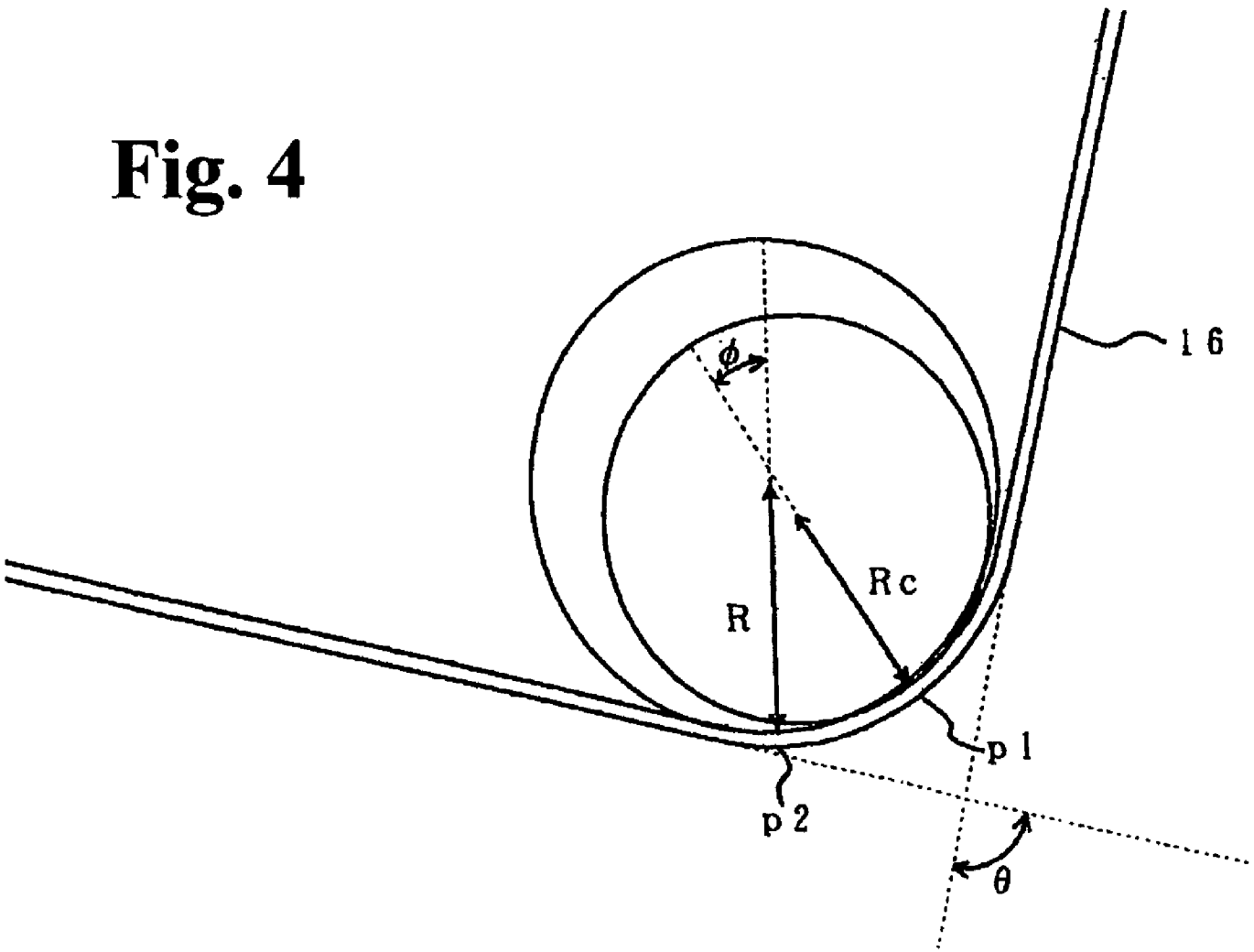
FIG. 4 is a schematic view showing a curved portion of a developing blade formed with a bending process according to a second embodiment of the present invention.

A second embodiment of the present invention will be explained next. Components same as those in the first embodiment are denoted by the same reference numerals, and explanations thereof are omitted. In the second embodiment, a printer has a configuration same as that in the first embodiment, and will be explained with reference to FIG. 1 showing the printer of the first embodiment. FIG. 4 is a schematic view showing a curved portion of the developing blade 16 formed with a bending process according to the second embodiment of the present invention.

When the developing blade 16 is manufactured with the bending process, a plate member formed of an elastic material is bent in an L shape with a metal mold. As shown in FIG. 4, a bending angle θ is within a range of 40° to 100° (40°≦θ≦100°). Further, when Rc represents a curvature radius of a top p1 of the curved portion of the developing blade 16, and R represents a curvature radius at an abutting point p2 between the developing blade 16 and the developing roller 14, a ratio of R to Rc (R/Rc) meets the following relation.

$$1.0 \leqq R/Rc \leqq 1.2$$

Figure 5:
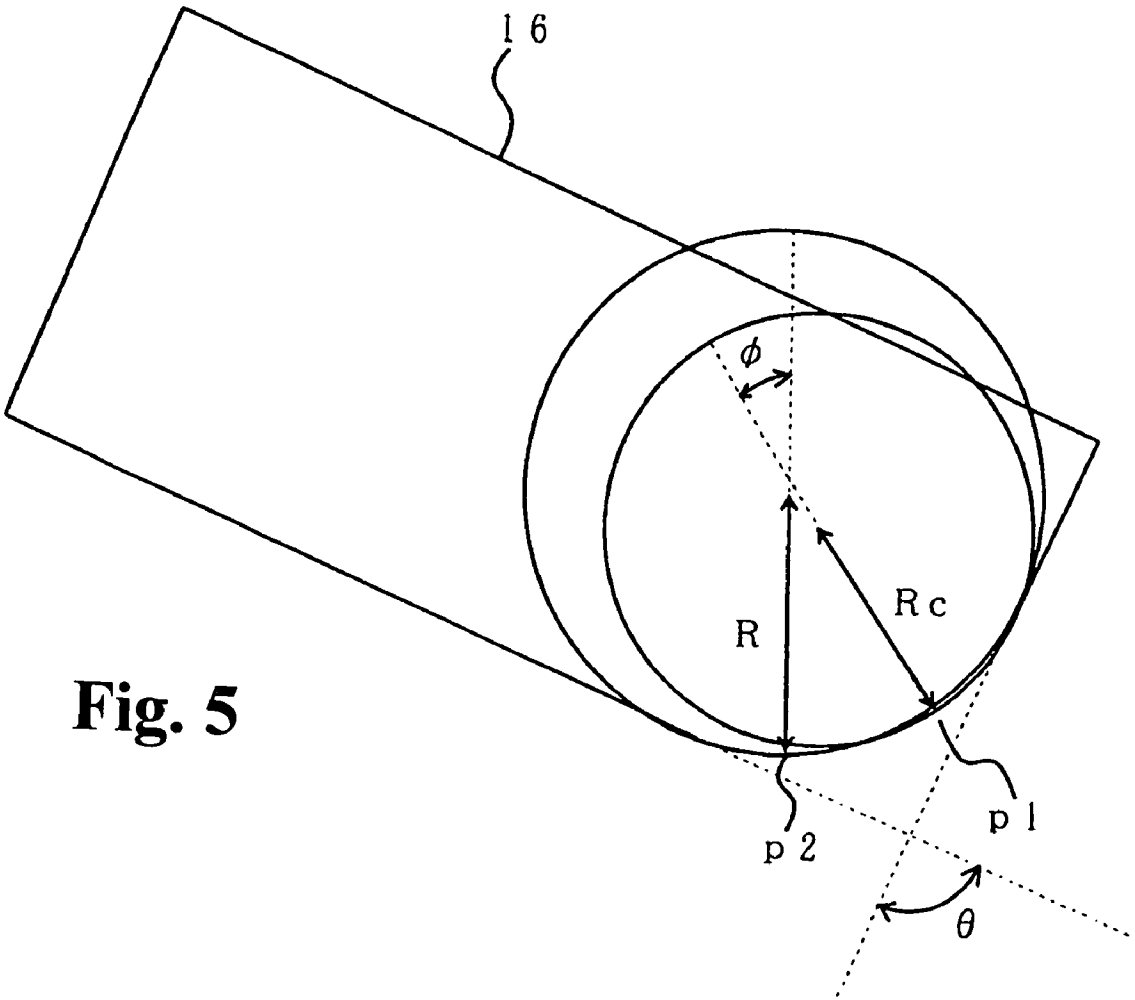
FIG. 5 is a schematic view showing a curved portion of a developing blade formed with a grinding process according to the second embodiment of the present invention.

FIG. 5 is a schematic view showing a curved portion of the developing blade 16 formed with a grinding process according to the second embodiment of the present invention. When the developing blade 16 is manufactured with the grinding process, a plate member formed of an elastic material is ground and polished. Similar to the bending process, as shown in FIG. 5, the bending angle θ is within a range of 40° to 100° (40°≦θ≦100°). Further, when Rc represents a curvature radius of a top p1 of the curved portion of the developing blade 16, and R represents a curvature radius at an abutting point p2 between the developing blade 16 and the developing roller 14, a ratio of R to Rc (R/Rc) meets the following relation.

$$1.0 \leqq R/Rc \leqq 1.2$$

An operation of the developing blade 16 according to the second embodiment will be explained next. After toner is supplied to the developing unit 20 from a toner storage unit (not shown), the toner supply roller 15 supplies toner to the developing roller 14. At this time, toner is attached to the surface of the developing roller 14 to form a toner layer with a random thickness, not a uniform thickness. When the developing roller 14 rotates to pass the toner layer with a random thickness through the abutting portion between the developing roller 14 and the developing blade 16, the developing blade 16 scrapes excess toner to make the thickness of the toner layer uniform. At this time, the thickness of the toner layer is determined by the curvature radius R of the abutting portion p2 at the curved portion of the developing blade 16. After toner is uniformly attached to the surface of the developing roller 14, toner is attached to a latent static image on the surface of the photosensitive drum 11, thereby forming a toner image on the surface of the photosensitive drum 11.

The charged state of toner supplied from the toner supply roller 15 to the developing roller 14 greatly depends on an environment where the printer is used or a state of the printer in use. For example, when a printer is used under a high temperature and a high humidity, a charge amount of toner tends to increase. When a printer prints sheets sequentially, a charge amount of toner tends to increase. When a printer stays for a long time without printing, a charge amount of toner tends to decrease. As described above, when the toner supply roller 15 supplies toner to the developing roller 14, toner on the surface of the developing roller 14 repels with each other, and a repel force increases as a charge amount of toner increases. When toner repels with each other, the developing blade 16 is lifted from the surface of the developing roller 14, thereby shifting a position of the abutting portion p2.

In the present invention, the curvature radius of the curved portion of the developing blade 16 increases from the top p1 toward a downstream side in a direction that the developing roller 14 rotates. Accordingly, when the developing blade 16 is lifted and the abutting portion p2 is shifted, a difference between the curvature radius Rc at the top p1 and the curvature radius R of the abutting portion p2 increases.

Figure 6:
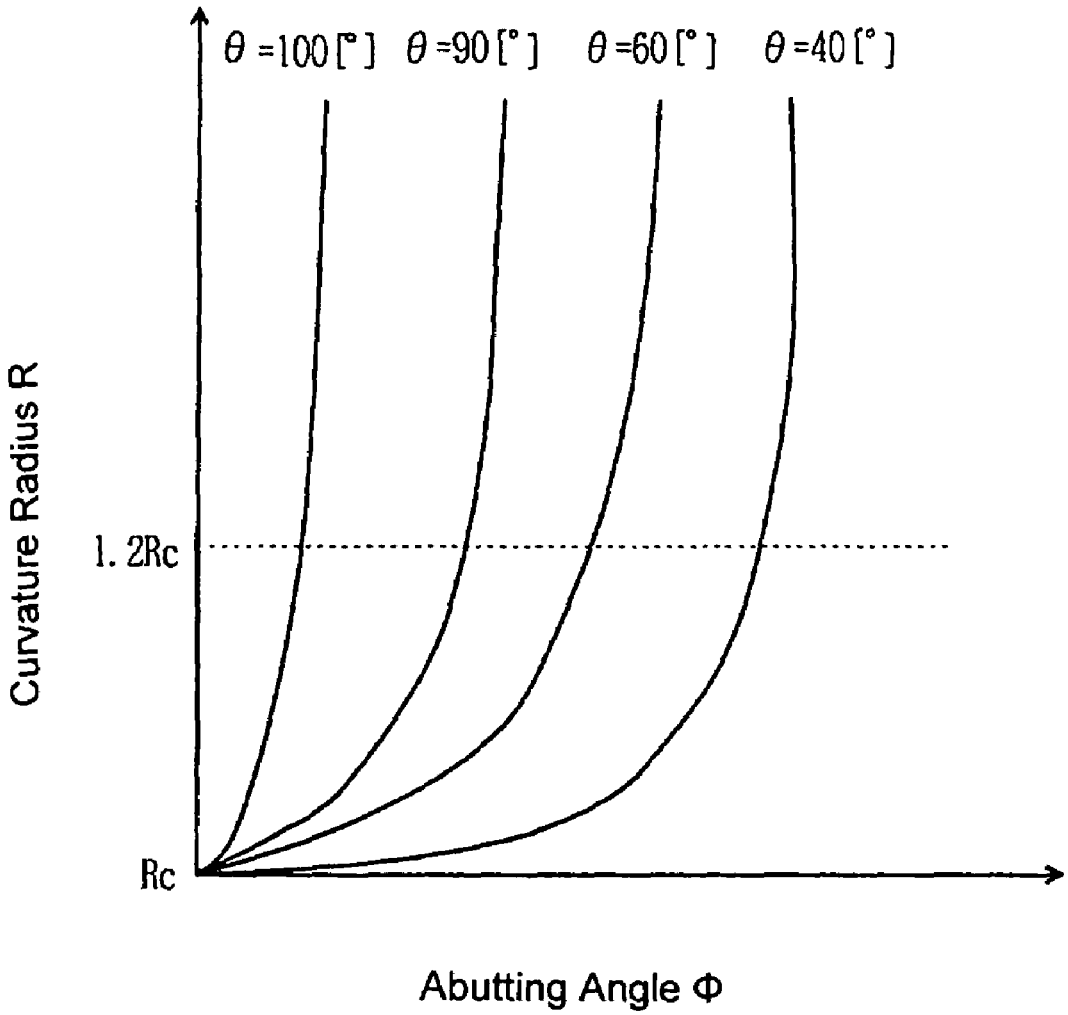
FIG. 6 is a graph showing a relationship between an abutting angle of the developing blade and a curvature radius of an abutting portion according to the second embodiment of the present invention.

FIG. 6 is a graph showing a relationship between an abutting angle Φ of the developing blade 16 and the curvature radius R of an abutting portion p2 according to the second embodiment of the present invention. As shown in FIGS. 4 and 5, the abutting angle Φ is defined by a first normal line between the top p1 of the curved portion of the developing blade 16 and a center of a circle of the curvature radius R and a second normal line between the abutting portion p2 and a center of a circle of the curvature radius R. The abutting angle Φ increases as the abutting portion p2 is shifted toward a downstream side in a direction that the developing roller 14 rotates.

As shown in FIG. 6, the curvature radius R increases as the abutting angle Φ increases. Further, an increasing rate of the curvature radius R relative to an increase in the abutting angle Φ increases as a bending angle θ of the developing blade 16 increases. Accordingly, in order to expand a range of the abutting angle Φ in which the ratio of the curvature radius R to the curvature radius Rc (R/Rc) meets the following relation, $$1.0 \leqq R/Rc \leqq 1.2$$

it is preferred that the developing blade 16 has a small bending angle θ.

Figure 7:
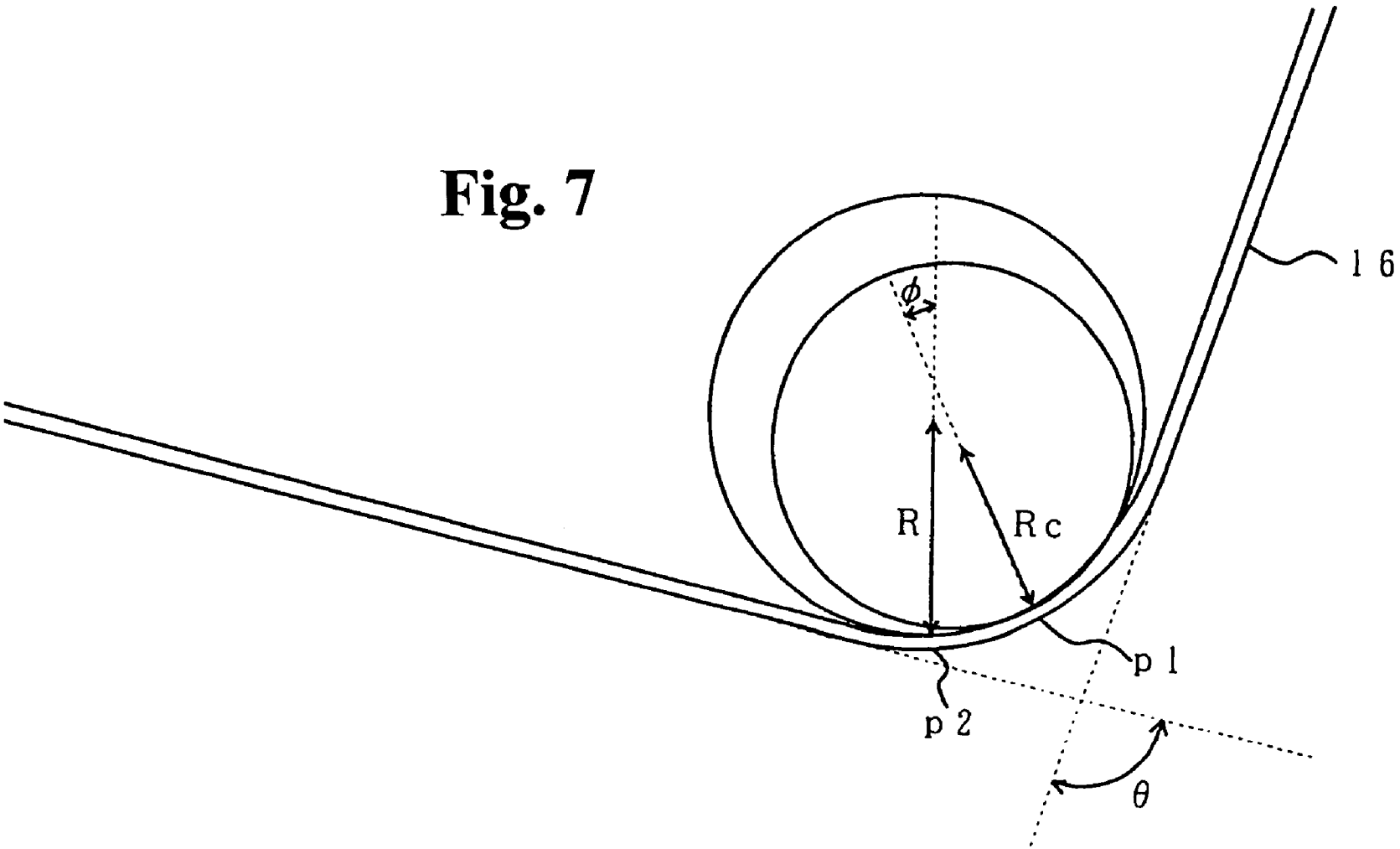
FIG. 7 is a schematic plan view showing the curved portion when a bending angle of the developing blade is maximum according to the second embodiment of the present invention.

A maximum value and a minimum value of the bending angle of the developing blade 16 will be explained next. FIG. 7 is a schematic plan view showing the curved portion when the bending angle θ of the developing blade 16 is maximum according to the second embodiment of the present invention. As shown in FIG. 7, when the bending angle θ exceeds 100°, it is difficult to adjust a change in an environment where the printer is used or a state of the printer in use. This is because it is difficult to obtain a sufficient range of the abutting angle Φ at which the ratio of the curvature radius R to the curvature radius Rc (R/Rc) meets the relation 1.0≦R/Rc≦1.2.

Further, when the bending angle θ exceeds 100°, it is necessary to remove toner into a small area after the developing blade 16 scrapes toner on the surface of the developing roller 14. Accordingly, after scraping, toner may pass through the abutting portion between the developing roller 14 and the developing blade 16. As a result, a large amount of toner is attached to the surface of the developing roller 14 with time. For the reasons described above, in the embodiment, the bending angle θ is preferably less than 100°.

Figure 8:
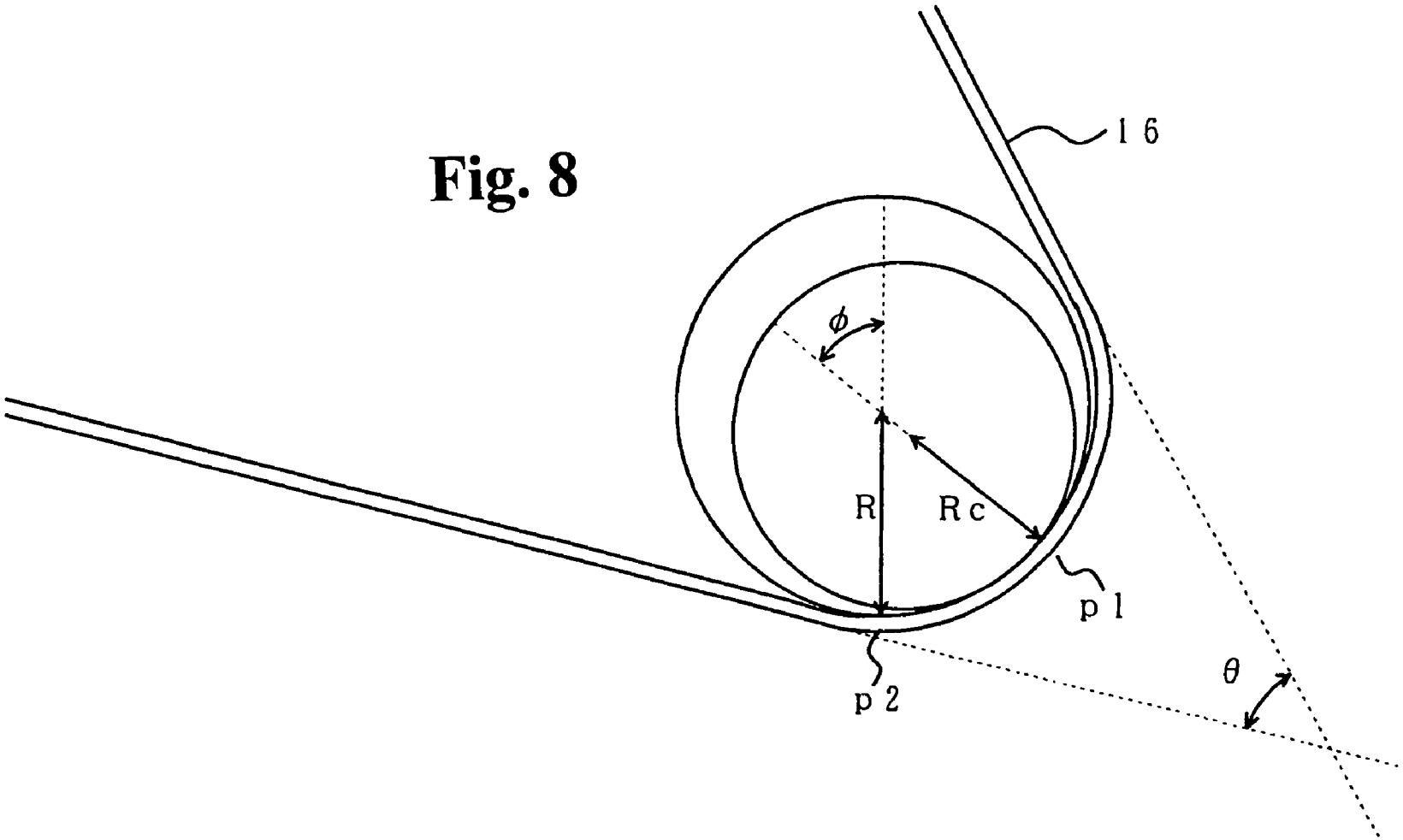
FIG. 8 is a schematic enlarged view showing the curved portion when a bending angle of the developing blade is minimum according to the second embodiment of the present invention.

FIG. 8 is a schematic enlarged view showing the curved portion when the bending angle θ of the developing blade 16 is minimum according to the second embodiment of the present invention. As shown in FIG. 8, when the bending angle θ is less than 40°, it is possible to expand a range of the abutting angle Φ in which the ratio of the curvature radius R to the curvature radius Rc (R/Rc) meets the relation 1.0≦R/Rc≦1.2. However, when the bending angle θ is less than 40°, it is difficult to secure a large range of an installation angle at which the developing blade 16 can be stably arranged relative to the surface of the developing roller 14.

More specifically, in order to scrape toner on the surface of the developing roller 14 with the developing blade 16, it is necessary to press the developing blade 16 against the surface of the developing roller 14 with a specific pressing force. At this time, the developing blade 16 is preferably arranged at an installation angle, so that a direction of the force of the developing blade 16 applied to the developing roller 14 is close to the first normal line at the top p1 of the curved portion of the developing blade 16. However, when the direction of the force becomes too close to the first normal line at the top p1 of the curved portion of the developing blade 16, the developing blade 16 may be twisted or deformed as the developing roller 14 rotates.

Further, when the bending angle θ is less than 40°, it is difficult to secure a sufficient contact area for scraping toner on the surface of the developing roller 14, thereby making it difficult to form the toner layer with a uniform thickness on the surface of the developing roller 14. Accordingly, in the embodiment, the bending angle θ is preferably greater than 40°.

As described above, in the embodiment, the bending angle θ is within a range of 40° to 100° (40°≦θ≦100°), Accordingly, it is possible to reduce the variance in the attached toner amount less than 0.1 mg. It is also possible to secure a large range of the installation angle at which the developing blade 16 can be stably arranged, thereby making it possible to stably form an image.

The disclosure of Japanese Patent Application No. 2004-246454, filed on Aug. 2, 2004, is incorporated in the application.

While the invention has been explained with reference to the specific embodiments of the invention, the explanation is illustrative and the invention is limited only by the appended claims.

What is claimed is:

1. A developing device comprising:

a developer support member; and a developing blade having a curved portion abutting against the developer support member, wherein a ratio of a minimum curvature radius Rc of the curved portion of the developing blade and a curvature radius R of the curved portion at an abutting point where the curved portion abuts against the developer support member establishes a relation of 1.09≦R/Rc≦1.2.

2. The developing device according to claim 1, wherein said developing blade abuts against the developer support member at the abutting point situated at a downstream side of the curved portion having the curvature radius Rc.

3. The developing device according to claim 1, wherein said developing blade includes a bent plate member.

4. The developing device according to claim 3, wherein said bent plate member has a thickness of 0.05 to 0.50 mm.

5. The developing device according to claim 1, wherein said developing blade includes the curved portion having the curvature radius Rc between 0.1 and 1.0 mm, said developing blade abutting against the developer support member at the abutting point having the curvature radius R between 0.1 and 1.0 mm.

6. The developing device according to claim 1, wherein said developing blade includes a portion having a surface roughness less than 1 μm, wherein the surface roughness is obtained from a sum of a first average of absolute heights of highest to fifth highest portions from an average line obtained from a roughness profile of the developing blade plate along an average line in a standard length and a second average of absolute heights of deepest to fifth deepest portions from the average line in the standard length.

7. The developing device according to claim 1, wherein said developing blade includes the curved portion having a bending angle within a range of 40° to 100°.

8. An image forming device comprising the developing device according to claim 7.

9. An image forming device comprising the developing device according to claim 1.

* * * * *